US007143554B2

(12) United States Patent
Sachs et al.

(10) Patent No.: US 7,143,554 B2
(45) Date of Patent: Dec. 5, 2006

(54) COMPOSITE COLUMN AND BEAM FRAMING MEMBERS FOR BUILDING CONSTRUCTION

(76) Inventors: Melvin H. Sachs, 27112 Gateway Dr. South, Apt.# 108, Farmington Hills, MI (US) 48334; Gerald W. Burek, 2351 Sunset Blvd., #170103, Rocklin, CA (US) 95765

( * ) Notice: Subject to any disclaimer, the term of this patent is extended or adjusted under 35 U.S.C. 154(b) by 773 days.

(21) Appl. No.: 09/930,042

(22) Filed: Aug. 15, 2001

(65) Prior Publication Data

US 2002/0026764 A1 Mar. 7, 2002

Related U.S. Application Data

(60) Provisional application No. 60/225,337, filed on Aug. 15, 2000.

(51) Int. Cl.
*E04B 1/00* (2006.01)

(52) U.S. Cl. ..... 52/251; 52/742.13; 52/232

(58) Field of Classification Search ..... 52/721.4, 52/724.1, 724.5, 596, 251, 723.1, 405.3, 52/425, 232, 259, 260, 404.1, 742.13, 737.2
See application file for complete search history.

(56) References Cited

U.S. PATENT DOCUMENTS

| | | | | |
|---|---|---|---|---|
| 1,757,077 A | | 5/1930 | Eiserloh | |
| 2,731,824 A | | 1/1956 | Hadley | 72/8 |
| 4,019,301 A | * | 4/1977 | Fox | 405/216 |
| 4,211,045 A | | 7/1980 | Koizumi et al. | 52/251 |
| 4,333,285 A | | 6/1982 | Koizumi et al. | 52/252 |
| 4,409,764 A | * | 10/1983 | Wilnau | 52/127.3 |
| 4,722,156 A | | 2/1988 | Sato | 52/98 |
| 4,783,940 A | | 11/1988 | Sato et al. | 52/98 |
| 4,905,440 A | | 3/1990 | Schilger | 52/368 |
| 5,050,358 A | * | 9/1991 | Vladislavic | 52/334 |
| 5,678,375 A | | 10/1997 | Juola | 52/655.1 |
| 6,349,520 B1 | * | 2/2002 | Kubica | 52/426 |

OTHER PUBLICATIONS

Hawley's Condensed Chemical Dictionary, Richard J. Lewis, Sr. 1997, John Wiley & Sons, 13, 200, 201, 538, 756.*
Merriam-Webster's Collegiate Dictionary. 1999, Merriam-Webster Incorporated, 10, 740.*
Merriam-Webster's Collegiate Dictionary. 1999, Merriam-Webster Incorporated, 10, 740.*

* cited by examiner

*Primary Examiner*—Naoko Slack
(74) *Attorney, Agent, or Firm*—Gifford, Krass,Groh, Sprinkle, Anderson & Citkowski, P.C.

(57) ABSTRACT

Composite framing members for use in building construction include reinforced concrete columns and beams surrounded by a pair of steel shells. A layer of protective material is applied to the interior surface of at least one shell prior to assembly of the shell to provide the final integrated framing member with superior insulating or fire resistance and survivability characteristics. Additionally, the steel shells impart greater structural strength and integrity than the reinforced concrete columns and beams could alone. Furthermore, the concrete cores, aided by the protective coating, function as a heat sink, absorbing heat and allowing the entire framing member a longer structural life that it would have if the steel or concrete were used alone.

17 Claims, 4 Drawing Sheets

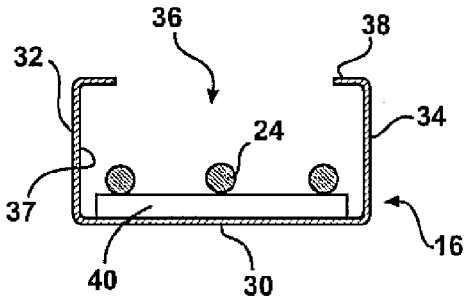
FIG - 2
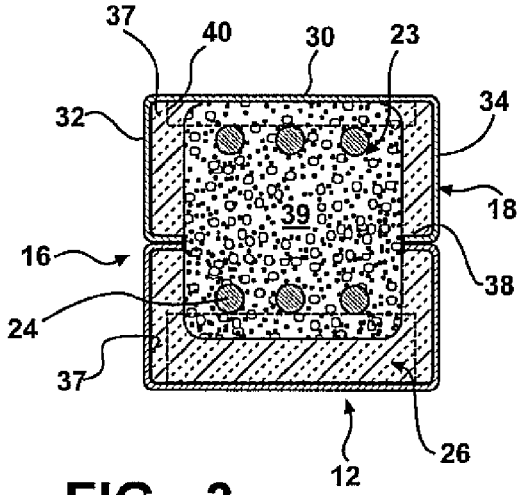
FIG - 3
FIG - 4
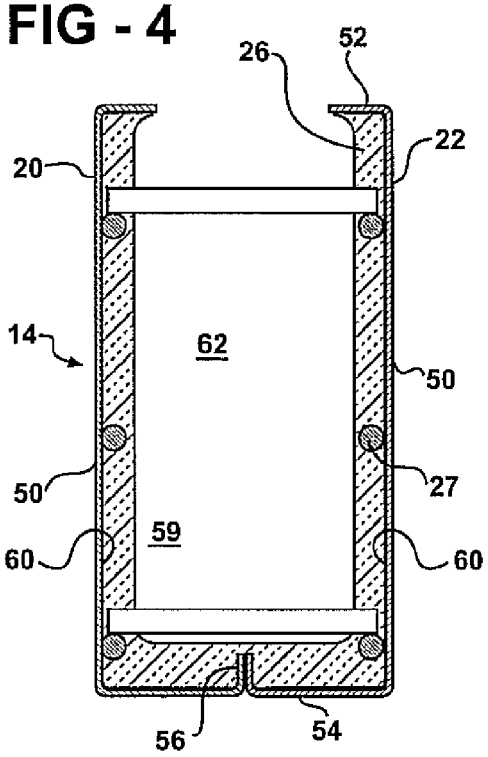
FIG - 5
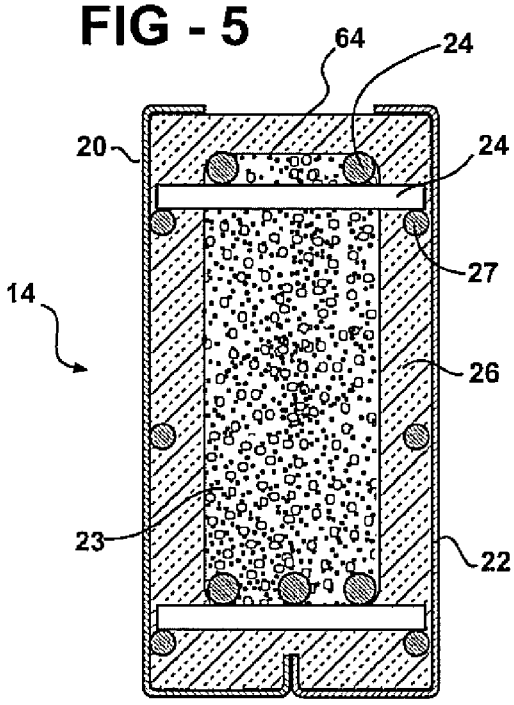

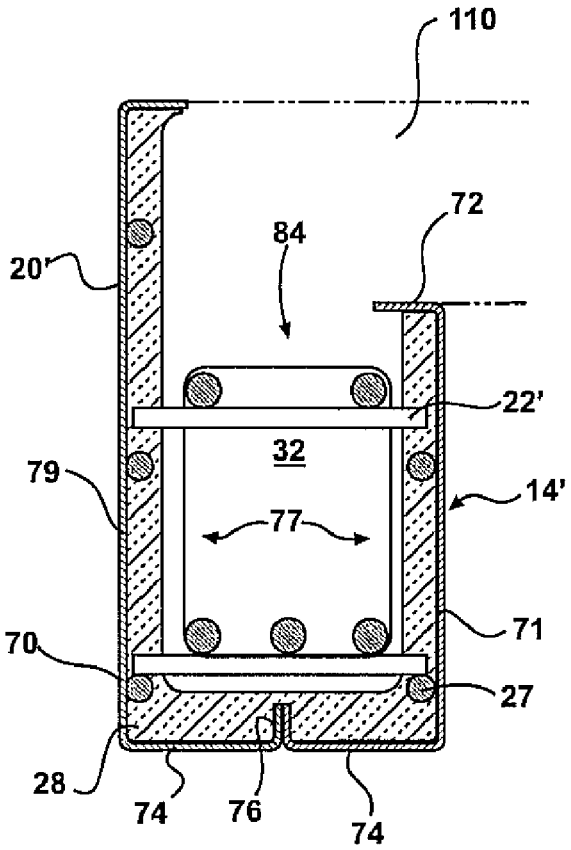
FIG - 6
FIG - 7
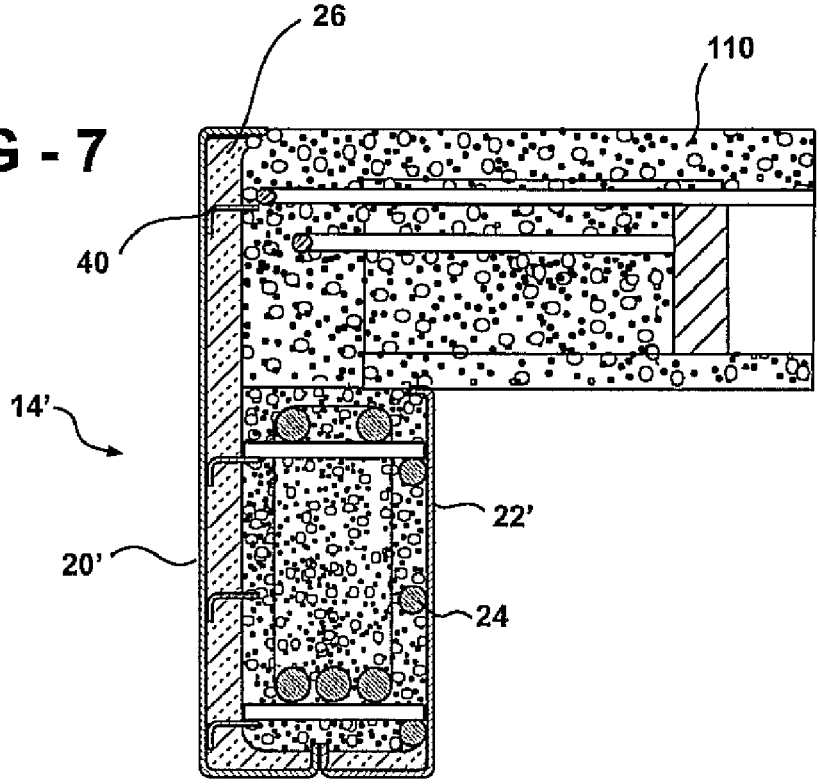

COMPOSITE COLUMN AND BEAM FRAMING MEMBERS FOR BUILDING CONSTRUCTION

RELATED APPLICATION

This application claims priority of U.S. Provisional Patent Application 60/225,337 filed Aug. 15, 2000, and is incorporated herein by reference.

BACKGROUND OF THE INVENTION

1. Field of the Invention

The present invention is directed to composite column and beam framing members for use in building construction. More particularly, the present invention is directed to a composite column or beam and a method for its manufacture that has superior insulating and fire/heat resistance characteristics.

2. Reference to Related Art

It is well known that the steel beams and columns that are used as the structural framework of modem buildings are not fireproof. Indeed, when exposed to heat and fire, steel beams and columns will expand, warp and rapidly lose strength. To protect against this type of extreme structural damage as well as the ongoing effects of weather, modem building codes often require that a coating of protective material be applied to the exterior surface of a building's steel framework. These protective materials are typically classified as either fire-resistant materials (i.e. mineral wool, fiberglass or the like) or heat sink materials (e.g. gypsum board or cement plasters). However, additional types of thermal or weather insulation may also be thought of as protective materials. Either class of fire-protective material can, for a reasonable period of time (e.g., one to three hours), be designed to delay the heat from a fire from affecting the steel framework.

Reinforced concrete framing systems, either pour-in-place or precast/prefabricated systems, do offer some known advantages over steel framing systems in the area of fire protection. However, columns and beams constructed of reinforced concrete have the notable disadvantage of being larger and heavier than steel framing members with the same capacity. Additionally, reinforced concrete systems necessarily require the builder to use concrete forms as part of the construction process. The erection, installation and removal of those forms can add significant cost (in time and labor) to any construction project.

Composite beam and column framing members that combine steel and concrete represent a compromise between pure steel or concrete building framing systems and are known in the art. One example is U.S. Pat. No. 4,333,285, which discloses a concrete column encased in a unitary steel tube. The column is adapted to support a reinforced concrete beam that is sheathed in a steel shell.

U.S. Pat. No. 4,409,764 discusses the use of steel column and beam forms that include internal metal reinforcing skeletons. The forms are prepared at an off-site factory and subsequently erected at the building site. The steel forms are filled with concrete at the building site and remain in place as a permanent part of the building framework.

Finally, U.S. Pat. No. 5,678,375 discusses a building framework that includes a number of structural steel members that each has a hollow interior. The steel members have openings that permit the hollow interiors to be filled with concrete in conjunction with the construction of the building frame.

Composite columns and beams are generally stronger than concrete framing members of similar size and are lighter than steel framing members. However, composite framing members still suffer from an increased risk of damage as a result of exposure to heat and flame. Therefore, it would be beneficial to provide improved composite column and beam framing members that have superior insulating, thermal and/or fire resistance characteristics.

SUMMARY OF THE INVENTION

The present invention is directed to a composite column or beam framing member for use in building construction and a method of manufacturing the column or beam. Preferably, the composite framing member includes a pair of elongated shell members that have a length dimension that is greater than a width dimension. Each shell has one substantially open side that extends along the length of the shell and provides access to an interior channel that is defined by the walls of the shell. The shells are securable to each other along their open sides such that the interior channels of the shells cooperate to define a structural member having an interior volume.

Prior to being secured together, reinforcing bars are positioned throughout the interior channel as required by the user. Spacers or risers may also be positioned along the surface of the interior channel in order to maintain the reinforcing bars a predetermined distance from the interior surface of the channel. Additionally, the interior channel of at least one of the shell members may be coated with protective materials (i.e., insulation). The use of a protective material is most preferred when at least a portion of framing members of the present invention are exposed to the exterior of a building. Under such conditions, the use of a protective material on the internal surface(s) of the framing member (particularly those having exposed external surfaces) provides the framing member with an additional defense against condensation, corrosion, fire and heat.

Preferably, the composite structural member is erected (in the case of a column) or positioned (in the case of a beam) at the work site and filled with concrete according to the needs or requirements of the user.

A preferred method for constructing the composite framing members of the present invention includes a first step of providing a first and a second shell member. Each shell is elongated so as to have a length dimension that is greater than a width dimension and includes one substantially open side extending along the length dimension. The shells are preferably U- or L-shaped such that the walls of each shell define an interior channel.

In a second step, at least one spacing bar (e.g., a steel reinforcing rod) is secured along the interior surface of each shell.

In a third step, a protective material (i.e., thermal/weather insulation) is applied into the interior channel of at least one of the shells following the insertion of the at least one spacing bar into the interior channel of each shell.

In a fourth step, the first and second shells are secured together at least partially along their respective substantially open sides so that the interior channels of the first and second shell members cooperate to define either a hollow column or open beam having an interior volume.

In a fifth step, at least one reinforcing member is installed within the interior volume formed by the shells.

In a sixth step, the interior volume of the column or beam is filled with a filler material (e.g., concrete).

Therefore, the framing members of the present invention include reinforced concrete columns and beams surrounded by steel shells. The shells impart greater structural strength and integrity than the reinforced concrete columns and beams could alone. Furthermore, the concrete core of the framing member, which is aided by the use of a coating of protective material, functions as a heat sink, absorbing heat and allowing the entire framing member a longer structural life than it would have if the steel or concrete were used alone.

BRIEF DESCRIPTION OF THE DRAWINGS

The invention will now be described in more detail with reference being made to the accompanying drawings in which:

FIG. 2 is a planar end view of a shell for use in constructing a column in accordance with the present invention;

FIG. 3 is a planar end view of a column according to a preferred embodiment of the present invention;

FIG. 4 is a planar end view of a shell for use in constructing a beam in accordance with the present invention;

FIG. 5 is a planar end view of a beam according to a preferred embodiment of the present invention;

FIG. 6 is a planar end view of a shell for use in constructing a beam in accordance with an alternative embodiment of the present invention;

FIG. 7 is a planar end view of a beam according to an alternative embodiment of the present invention.

DETAILED DESCRIPTION OF THE PREFERRED EMBODIMENTS

Figure 1:
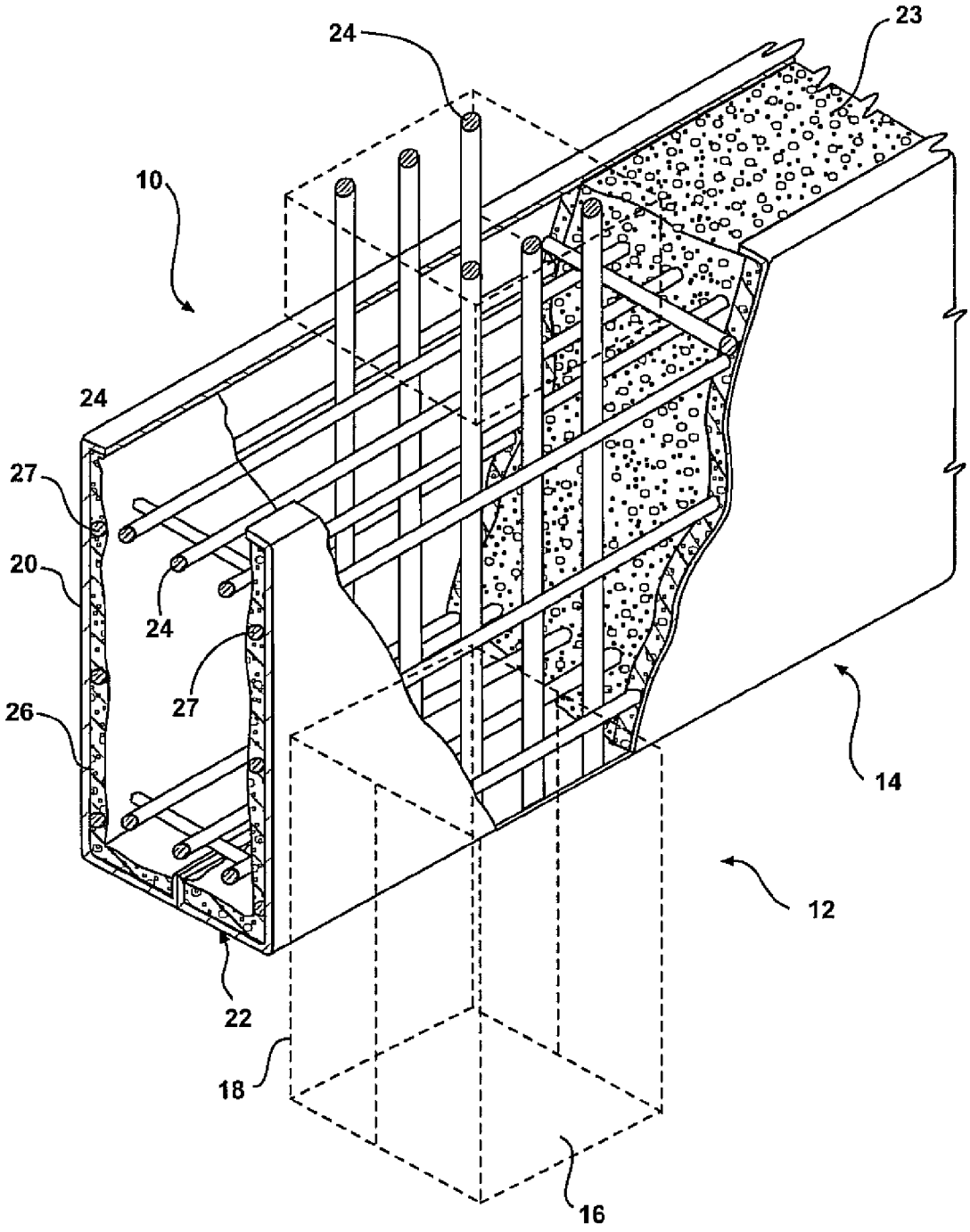
FIG. 1 is a perspective view of a preferred embodiment of the composite column or beam framing members constructed in accordance with the present invention.

Referring now to FIG. 1, there is shown in accordance with the present invention, a composite column and beam framing member system 10 for use in building construction. The framing system 10 includes column 12 and beam 14 framing members. Preferably, the column 12 has a first 16 and a second 18 elongated shell that each have a generally U-shaped appearance. The beam 14 includes a first 20 and a second 22 elongated shell that each have a generally L-shaped appearance. At least one reinforcing member 24 is secured within an interior of each shell 16, 18, 20, 22. A coating of protective material 26 is also applied on the interior surface of at least one of the shells 16, 18, 20, 22. The shells 16, 18, 20, 22 are preferably secured together and filled with a filler material 23 to form the column 12 and beam 14 structures of the present invention.

Referring now to FIGS. 1, 2 and 3, there is shown a column 12 constructed in accordance with the present invention. Preferably, the column 12 of the present invention includes a first 16 and a second 18 elongated shell member. Each shell member includes a base portion 30 and a pair of sidewalls 32, 34 that combine to provide the shells 16, 18 with a generally U-shaped appearance and form an interior channel 36. Flanges 38 extend inwardly toward the channel 36 from each sidewall 32, 34 and, as discussed below, are used in securing the shells 16, 18 together. Preferably, the shells are constructed of steel. However, it will be appreciated that other materials such as metal alloys or other known construction materials may also be used.

Still referring to FIGS. 1, 2 and 3, at least one reinforcing member 24 is secured within the interior channels 36 of each shell 16, 18. Preferably, the reinforcing member 24 is a steel reinforcing rod or the like. The reinforcing member 24 is preferably welded onto spacing bars 27 that are welded to the base 30 of each shell 16, 18. Alternatively, the reinforcing members may be secured or positioned upon a spacer 40 that is secured to the base 30 and extends upwardly from the base 30 a predetermined distance.

Following installation of the spacing bars 27, a coating of protective material 26 is applied to the surface 37 of the interior channel 36 of at least one of the shells 16, 18. The use of a protective material is most preferred when at least a portion of framing members of the present invention are exposed to the exterior of a building. Under such conditions, the use of a protective material on the internal surface(s) of the framing member (particularly those having exposed external surfaces) provides the framing member with an additional defense against condensation, corrosion, fire and heat.

Preferably, the protective material 26 is a known insulation material, such as weather insulation, a fire-resistant material (e.g., mineral wool or fiberglass), a heat sink material (e.g., gypsum board or cement plasters) or other type of thermal insulation material. Notably, coating the surface 37 of the interior channel 36 of at least one of the shells 16, 18 with the protective material 26 during the fabrication of the column 12 removes or limits the need to apply insulation to the column 12 in the field and provides the column 12 with superior insulative or fire/heat resistance characteristics.

Still referring to FIGS. 1, 2 and 3, preferably, the shells 16, 18 are secured together along their respective flanges 38 by welding or similar process. Securing of the shells along the open sides of the interior channel 36 provides the column 12 with a generally open, or hollow, interior that defines an interior volume 39. Following erection of the column 12 at a construction site, at least one reinforcing member 24 may be disposed into the interior volume 39 formed by the shells 16, 18. Finally, the interior volume 39 is filled with a filler material 23 that provides increased structural characteristics to the column. Preferably, the filler material 23 is concrete. However, other types of filler materials 23 may also be used according to the needs of the user.

Referring now to FIGS. 1, 4 and 5, there is shown a beam 14 framing member constructed in accordance with the present invention. Preferably, the beam 14 includes a first 20 and a second shell 22 member. Each shell 20, 22 has a generally L-shaped appearance that is defined by a base 50 having a first flange 52 that extends upwardly from the base 50 and a sidewall 54 having a flange 56 that extends inwardly from the sidewall 54. The base 50 and sidewall 54 of each shell 20, 22 form an interior channel 59. Similar to the column 12 discussed above, at least one spacing bar 27 is secured to the interior surface 60 of the interior channel 59 of each shell 20, 22. Thereafter, a coating of protective material 26 (as discussed above) is applied to the interior surface 60 of at least one of the shells 20, 22. The shells 20, 22 of the beam 14 are preferably secured together by welding the flanges 56 of the sidewalls 54 of the shells 20, 22.

Welding of the shells 20, 22 provides an elongated beam 14 framing member having a generally U-shaped appearance having an open interior defining an interior volume 62 that is accessible though an open side 64. Following erection of the beam 14 at a construction site, the interior volume 62 of the beam 14 may be disposed with reinforcing members 24 and then filled with a filler material 23 (as discussed above) that provides increased structural characteristics to the beam 14.

Referring now to FIGS. 6 and 7, there is shown an alternative embodiment of a beam 14' framing member constructed in accordance with the present invention. Preferably, the beam 14' includes a first 20' and a second shell 22' member. Each shell 20', 22' has a generally L-shaped appearance that is defined by a base 70, 71 having a first flange 72 that extends upwardly from the base 70 and a sidewall 74 having a flange 76 that extends inwardly from the sidewall 74. The base 70 and sidewall 74 of each shell 20', 22' form an interior channel 77. The base 70 of the first shell 20' is preferably wider than the base 71 of the second shell 22' such that a floor or roof system 110 may be adapted to abut against the first shell 20' while being supported by the beam 14'.

At least one spacing bar 27 is secured to the surface 79 of the base 70 of each shell 20', 22'. Alternatively, spacers 40 are provided along the surface 79 of at least one shell 20', 22' to support the span of the at least one reinforcing member 24 from one shell 20' to the other shell 22'. Following insertion of the spacing bars 27, a coating of protective material 26 (as discussed above) is applied to the interior surface of at least one of the shells 20', 22'. The shells 20', 22' of the beam 14' are then preferably secured by welding together the flanges 76 of the sidewalls 74 of the shells 20', 22'.

Welding of the shells 20', 22' provides an elongated beam 14' framing member having a generally U-shaped appearance having an open interior defining an interior volume 82 that is accessible though an open side 84. Following erection of the beam 14' at a construction site, the interior volume 82 of the beam 14' may be disposed with reinforcing members 24 and then filled with a filler material 23 (as discussed above) that provides increased structural characteristics to the beam 14'.

Figure 8:
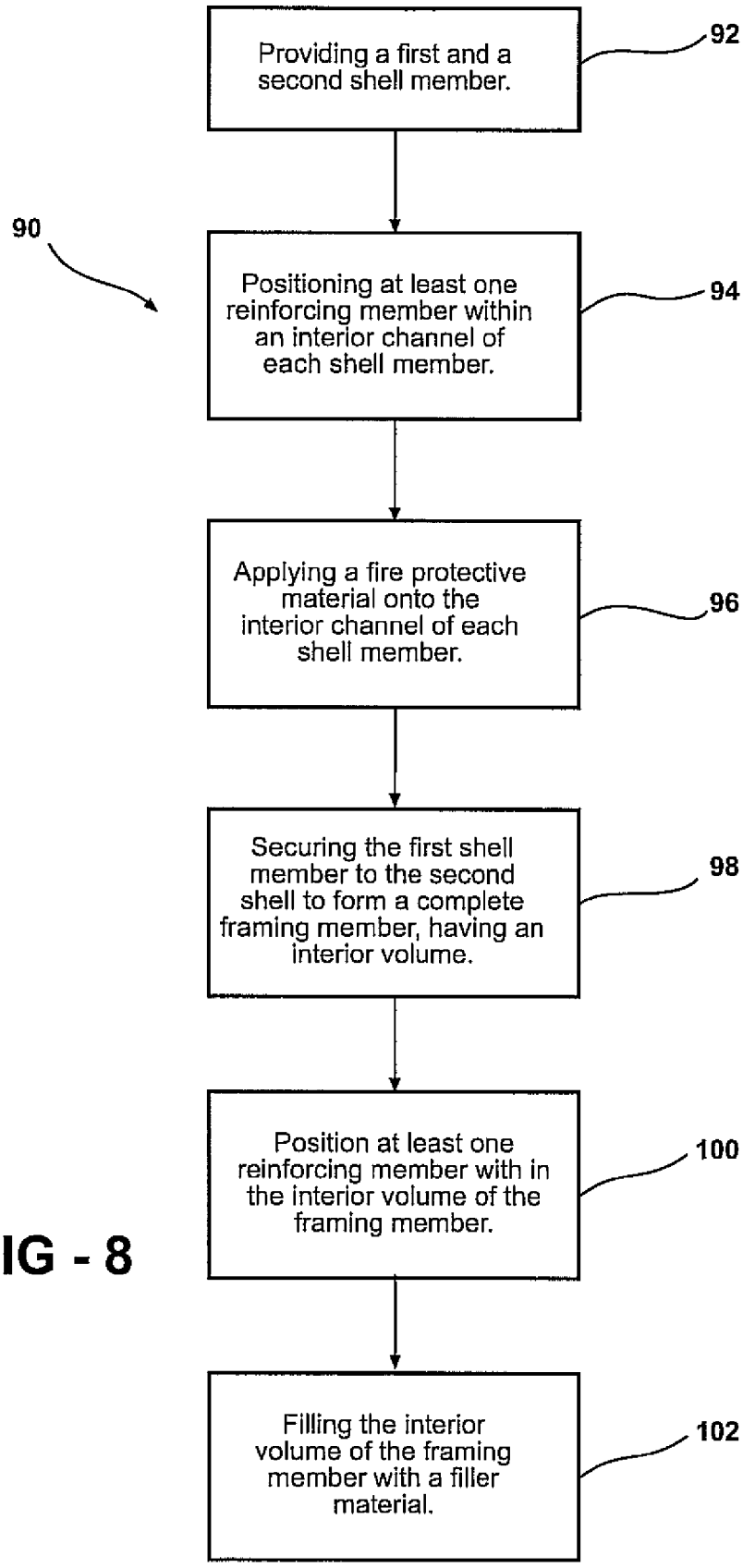
FIG. 8 is a diagrammatic view of a method for manufacturing a composite framing member in accordance with the present invention.

Referring now to FIG. 8, there is shown a method 90 for constructing a framing member in accordance with the present invention. Preferably, the method for construction includes a first step 92 of providing a first and a second shell member, each shell being elongated so as to have a length dimension that is greater than a width dimension and including one substantially open side extending along said length dimension. Additionally, the walls of the shells preferably provide the shells with a generally U- or L-shape and define an interior channel in each shell.

In a second step 94, at least one spacing bar 27 (e.g., a steel reinforcing rod) is positioned and secured to the interior surface of at least one of the shell members.

In a third step 96, a protective material is applied into the interior channel of each shell. As discussed above, the protective material 26 is preferably a known insulation material, such as weather insulation material, a fire-resistant material (e.g., mineral wool or fiberglass), a heat sink material (e.g., gypsum board or cement plasters) or other type of thermal insulation material.

In a fourth step 98, the first and second shells are secured together at least partially along their respective substantially open sides so that the interior channels of the first and second shell members cooperate to define a hollow column or open beam having an interior volume.

In a fifth step 100, the interior volume of the column or beam is disposed with at least one reinforcing member 24.

In a final step 102, the interior volume of the column or beam is filled with a filler material (e.g., concrete).

Therefore, by the present invention there is provided composite column and beam frame members for use in building structures that combine the characteristics of steel and reinforced concrete with superior fire-resistant qualities. However, having discussed several embodiments of the present invention, various modifications thereof will be apparent to those skilled in the art and, accordingly, the scope of the present invention should be defined only by the appended claims and equivalents thereof.

We claim:

1. A structural framing member comprising:

a first shell member and a structurally separate second shell member each being elongated so as to have a length dimension which is greater than a width dimension, each shell having an interior surface and including one substantially open side extending along said length dimension, each shell being configured so that said first shell member is securable to said second shell member so that said substantially open sides of said first and second shell members are at least partially contiguous and said first and second shell members cooperate to define an interior volume;

a protective material disposed on the interior surface of at least one of said shells;

at least one reinforcing member positioned within said interior volume defined by said first and second shell member; and a filler material disposed within said interior volume to secure said reinforcing member within said interior volume and wherein said filler material is of a different composition than said protective material.

2. The structural framing member of claim 1, wherein said first and second shell are generally u-shaped.

3. The structural framing member of claim 1, wherein said filler material is concrete.

4. The structural framing member of claim 1, wherein said first and second shells are generally l-shaped.

5. The structural framing member of claim 1, wherein a base of said first shell is wider than a base of said second shell.

6. The structural framing member of claim 1, wherein said protective material is a fire-resistant material.

7. The structural framing member of claim 6, wherein said fire-resistant material is mineral wool.

8. The structural framing member of claim 6, wherein said fire-resistant material is fiberglass.

9. The structural framing member of claim 1, wherein said fire protective material is a heat sink material.

10. The structural framing member of claim 9, wherein said heat sink material is gypsum board.

11. The structural framing member of claim 9, wherein said heat sink material is a cement plaster.

12. The structural framing member of claim 9, wherein said heat sink material is a concrete.

13. The structural framing member of claim 9, wherein said heat sink material is sand.

14. The structural framing member of claim 9, wherein said heat sink material is gravel.

15. The structural framing member of claim 1, wherein said protective material is a thermal insulation material.

16. A method for manufacturing a structural frame comprising:

providing a first shell member and a structurally separate second shell member each being elongated so as to have a length dimension which is greater than a width dimension, each shell member including one substantially open side extending along said length dimension and defining an interior channel;

applying a protective material to said interior surface of said at least one shell member;

securing said first shell member to said second shell member at least partially along said substantially open side so that the interior channels of the first and second shell members cooperate to define an interior volume;

positioning at least one reinforcing member within each of said interior channels of said first and second shell member; and filling said interior volume defined by said first and second shell member with a filler material having a different composition from said protective material so that said reinforcing members are secured within said interior volume.

17. A structural framing member comprising:

a first shell member and a structurally separate second shell member each being elongated so as to have a length dimension which is greater than a width dimension, each shell having an interior surface and including one substantially open side extending along said length dimension, each shell being configured so that said first shell member is securable to said second shell member so that said substantially open sides of said first and second shell members are at least partially contiguous and said first and second shell members cooperate to define an interior volume;

at least one spacing bar affixed to the interior surface of said first and second shell member;

a protective material applied on the interior surface of each of said shell members;

at least one reinforcing member disposed within the interior volume defined by said shell members; and a filler material disposed within the interior volume to secure said at least one reinforcing member within the interior volume wherein said filler material is a different composition from said protective material.

* * * * *